United States Patent [19]

Robert

[11] Patent Number: 5,052,371

[45] Date of Patent: Oct. 1, 1991

[54] SASH DOOR FOR A CLOSED FIREPLACE

[75] Inventor: Richard Robert, Thann, France

[73] Assignee: Fondis, S.A., Thann, France

[21] Appl. No.: 261,294

[22] Filed: Oct. 24, 1988

[30] Foreign Application Priority Data

Oct. 23, 1987 [FR] France ..... 87 14885
Mar. 25, 1988 [FR] France ..... 88 04146

[51] Int. Cl.[5] ..... F23M 7/00

[52] U.S. Cl. ..... 126/547; 126/546; 126/549; 49/389; 49/404

[58] Field of Search ..... 126/547, 544, 548, 549, 126/551, 546, 545, 500; 49/404, 424, 429, 431, 463, 389

[56] References Cited

U.S. PATENT DOCUMENTS 1,727,228 9/1929 Claybaugh et al. ..... 126/546
2,416,511 2/1947 Blanck ..... 49/389 X
2,921,350 1/1960 Kelly ..... 49/389 X
4,262,449 4/1981 Riegelman et al. ..... 49/404
4,574,773 3/1986 Moughamian ..... 126/549 X

FOREIGN PATENT DOCUMENTS 183633 6/1986 France ..... 126/547

*Primary Examiner*—Larry Jones
*Attorney, Agent, or Firm*—Schwartz & Weinrieb

[57] ABSTRACT

An improved guillotine-type door for a fireplace enclosure. An improved guillotine-type door, characterized by the fact that it opens by rotating around a lower pivoting axis (15), the ends of which are lower fingers (13) for guidance along vertical glides, the said lower fingers receiving the end attachment of the movable connection to the auxiliary mechanical device (31) for maneuvering, and being immobilized in the bottom lower position by a holding device (22), and by the fact that each vertical glide has a device for lateral disengagement at the level of each upper finger (14), for the purpose of allowing the door to be inclined, then pivoted around the lower axis (15). This invention is of interest for manufacturers of fireplace enclosures.

20 Claims, 6 Drawing Sheets

11
12
14
17
20
7
16
19
18
33
21
26
25
23
13
22
24
34
35
32
36
29
30
27
31
28

SASH DOOR FOR A CLOSED FIREPLACE

FIELD OF THE INVENTION

The present invention concerns an improved guillotine-type door for fireplace enclosures, particularly those with glass doors.

BACKGROUND OF THE INVENTION

There are various types of mechanisms for maneuvering guillotine-type doors for the purpose of closing off the volume exiting through the opening of the fireplace. These mechanisms generally comprise glides and an auxiliary mechanical device for raising and lowering, in order to compensate the weight of the moving mass, in the form of two parallel counterweights each connected by a movable connection, cable or chain, by way of a return, pulley or gearwheel, to a transverse element which is of one piece with the upper traverse of the door.

Although these devices facilitate maneuvering for opening and closing the door, they comprise hindrances and inconveniences in case of improper functioning.

In fact, blockage of the door in the closed, open or partially open position makes mechanical intervention difficult, because of the difficulty of access to the mechanism located at the upper part of the hood.

Furthermore, the heat released by the fireplace in the hood causes the risk that the glide track will become warped, which quickly translates into zones in which movement is difficult.

Maneuvering the door is thus made uncomfortable, even difficult.

Furthermore, cleaning of the rear side of the glass proves to be difficult, due to the lack of any real access through the fireplace.

OBJECT OF THE INVENTION

The present invention has as its purpose to remedy these various inconveniences.

SUMMARY OF THE INVENTION

To this end, it relates to an improved guillotine-type door for enclosed fireplaces, characterized by the fact that the guide fingers along vertical movement glides are connected, in the case of the lower fingers to the auxiliary mechanical device, while the upper fingers are made able to leave the glide by means of a device for lateral disengagement, in order to allow pivoting around a lower axis, with a virtual axis connecting the lower fingers which makes possible removal of the door by rotation into a lower horizontal position, leaving the fireplace completely open.

Many advantages result from the improved door according to the invention:

- easy cleaning and maintenance;
- faster and easier assembly and disassembly;
- free access to the movement mechanism and the mechanical weight compensation of the door;
- easy cleaning of the rear side of the glass in its flat position outside the fireplace;
- easy and fast replacement of the door;
- disengagement and pivoting by simple and sturdy means;
- easy mechanical intervention;
- the possibility of opening and pivoting comprises additional safety for access to the door;

- a removable, esthetic framework is able to conceal all the auxiliary mechanical mechanisms as well as the uprights and the upper traverse of the door frame.

Other specific advantages connected with a variation described below are as follows:

- precise and easy guidance in choosing the rail and the shoes of a synthetic, self-lubricating material;
- ease of disengagement at the top of the frame by simple extraction/retraction of the upper shoes;
- simple mechanical assembly;
- better quality of mechanical support on the glides, guaranteeing good stability;
- secure and reliable operation.

BRIEF DESCRIPTION OF THE DRAWINGS

The technical characteristics and other advantages of the invention are contained in the description which follows, and is given as a non-limiting example of an embodiment, with reference to the accompanying drawings, in which.

DETAILED DESCRIPTION OF THE ILLUSTRATED EMBODIMENTS

Figure 1:
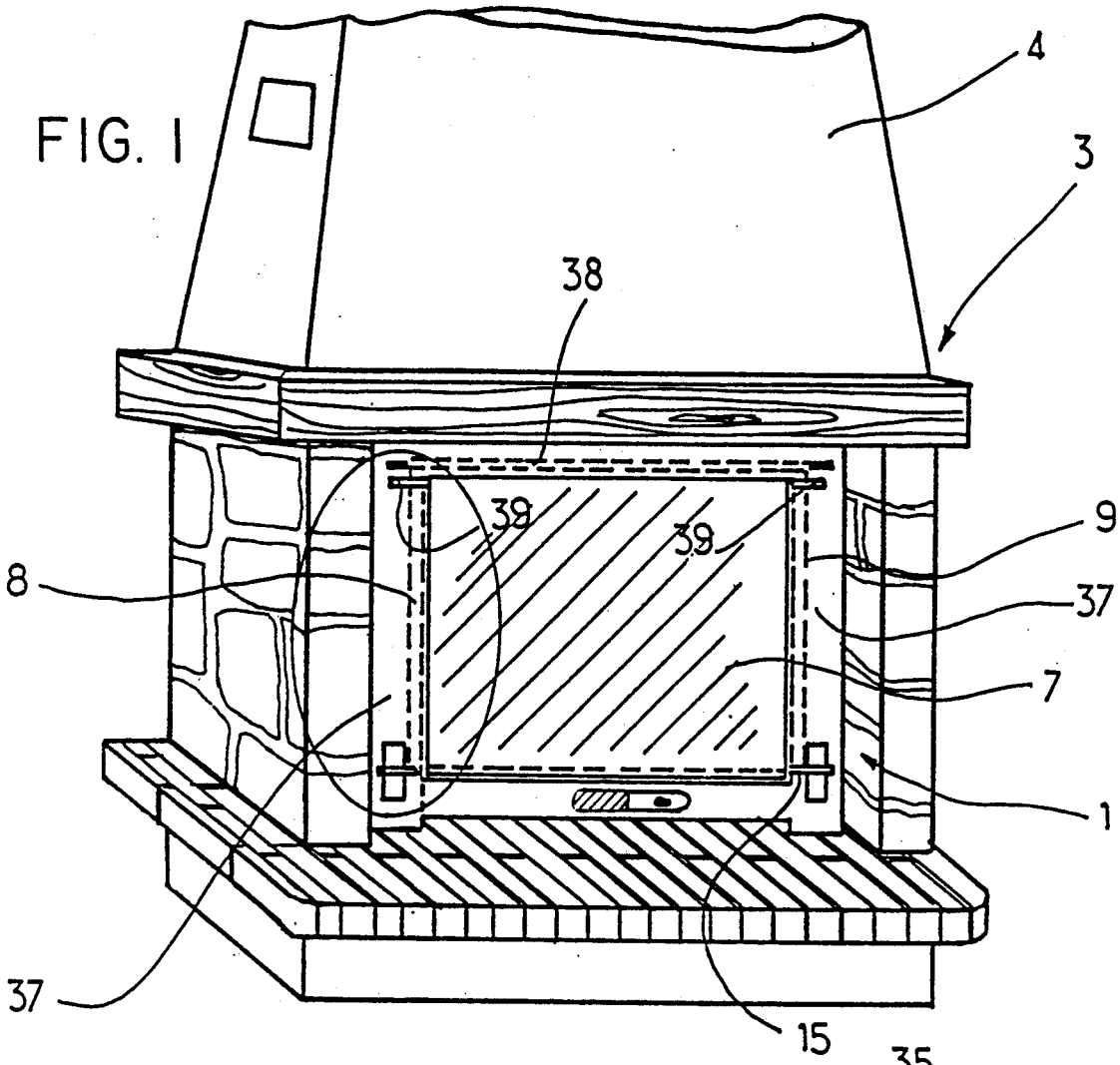
FIG. 1 is a general view, in perspective, of a fireplace provided with an enclosure equipped with the improved door according to the invention, and its mechanism for displacement and opening.
Figure 1A:
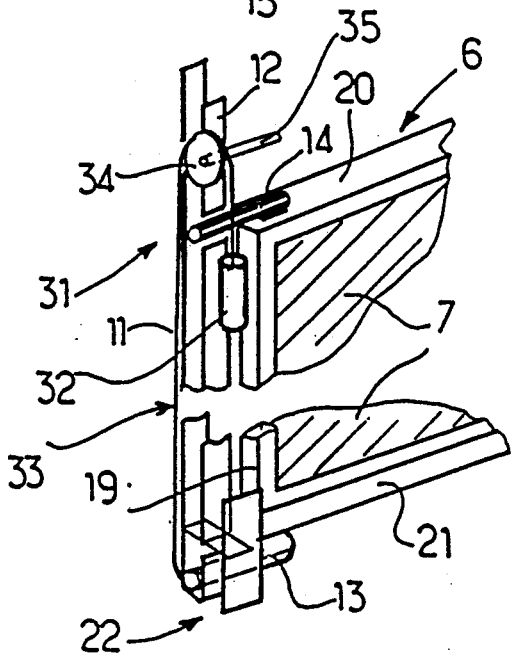
FIG. 1A is an enlargement of the circled portion of FIG. 1 showing one of the uprights, showing an embodiment of the device for holding the lower fingers.
Figure 2:
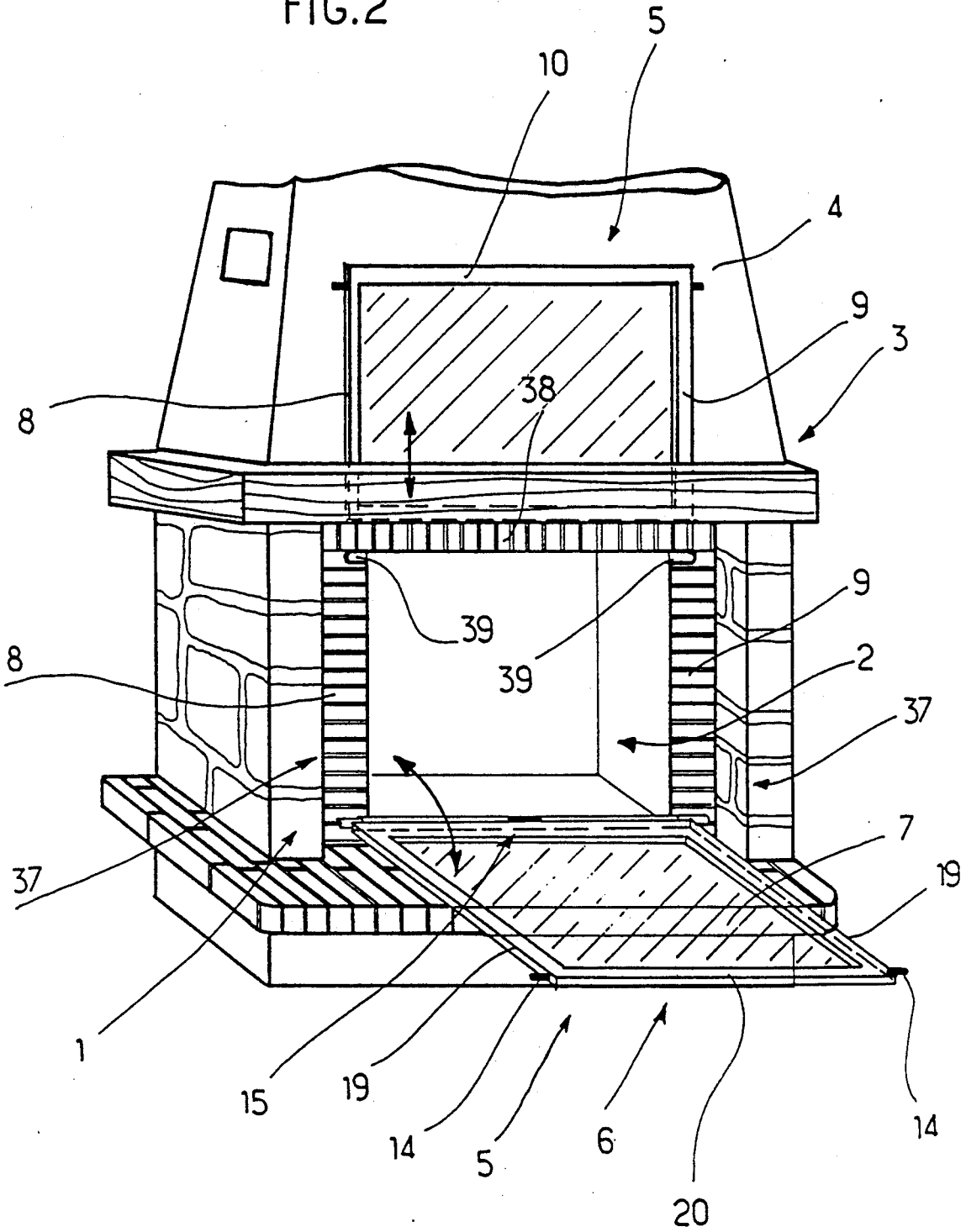
FIG. 2 is a simplified schematic view in perspective, showing the to opening positions of the door.

In the following, several embodiments of the general means of the invention will be described as examples. It is understood that any equivalent, derived or similar means are completely within the scope of the invention.

The general idea of the invention consists of moving down the hitching point of the auxiliary mechanical device for movement of a guillotine-type door used for an enclosed fireplace and of using a lower axis to implement pivoting, which brings the door into a lower position in which it is fully open and in which it lies flat.

In order to do this, the auxiliary mechanical device for movement of the door is moved down and connected by a flexible connection at the lower part of the door frame, the upper guide elements are able to escape laterally from the glides, to allow pivoting of the door downwards, all the way to a fully open, flat position.

More particularly, and as will be seen below, the lower guide elements along the glides are used as ends of the lower pivoting axis of the door, and as a point of attachment of the end of the connection to the auxiliary mechanical device for movement.

A metal box 1 surrounds a fireplace 2 with a chimney 3 having a hood 4. This box comprises, at the front part, a door 5 with a frame 6 holding a heat-resistant glass 7.

The door 5 is of the guillotine type, in other words it is moved vertically between a lower, closed position and an upper, open position, a position in which access to the interior of the box 1 is completely open.

The frame 6 of the door runs vertically along two parallel vertical glides 8 and 9, which run parallel upwards, being connected at the upper part by a traverse 10.

Each of the glides is formed, for example, of two flat irons 11 and 12 held parallel relative to one another by suitable mechanical elements which leave the interval which is kept constant between them free along their entire length.

Movement along the vertical glides is implemented by way of any suitable means.

More particularly, the frame is guided and carried on the glides 8 and 9 by means of upper and lower transverse elements, present at the ends of each upright, connected, for example, on the edges of the adjacent traverses, realized according to one embodiment in the form of lower fingers 13 and upper fingers 14, arranged in the vicinity of each corner of the frame.

According to the invention, a lower pivoting axis 15 is provided, which allows the door to be inclined forward and to become immobilized in a flat, completely open position.

According to a particular feature of the invention, the lower fingers 13 are correspondingly used as the ends of the lower pivoting axis 15.

To achieve this function, the upper fingers 14 must be able to pass through the vertical glides laterally, by means of a disengagement device 16.

To this end, these or means of the frontal element, flat iron or other present a passage, for example in the form of a slit 17.

Figures 3, 4, 5, 6, 7:
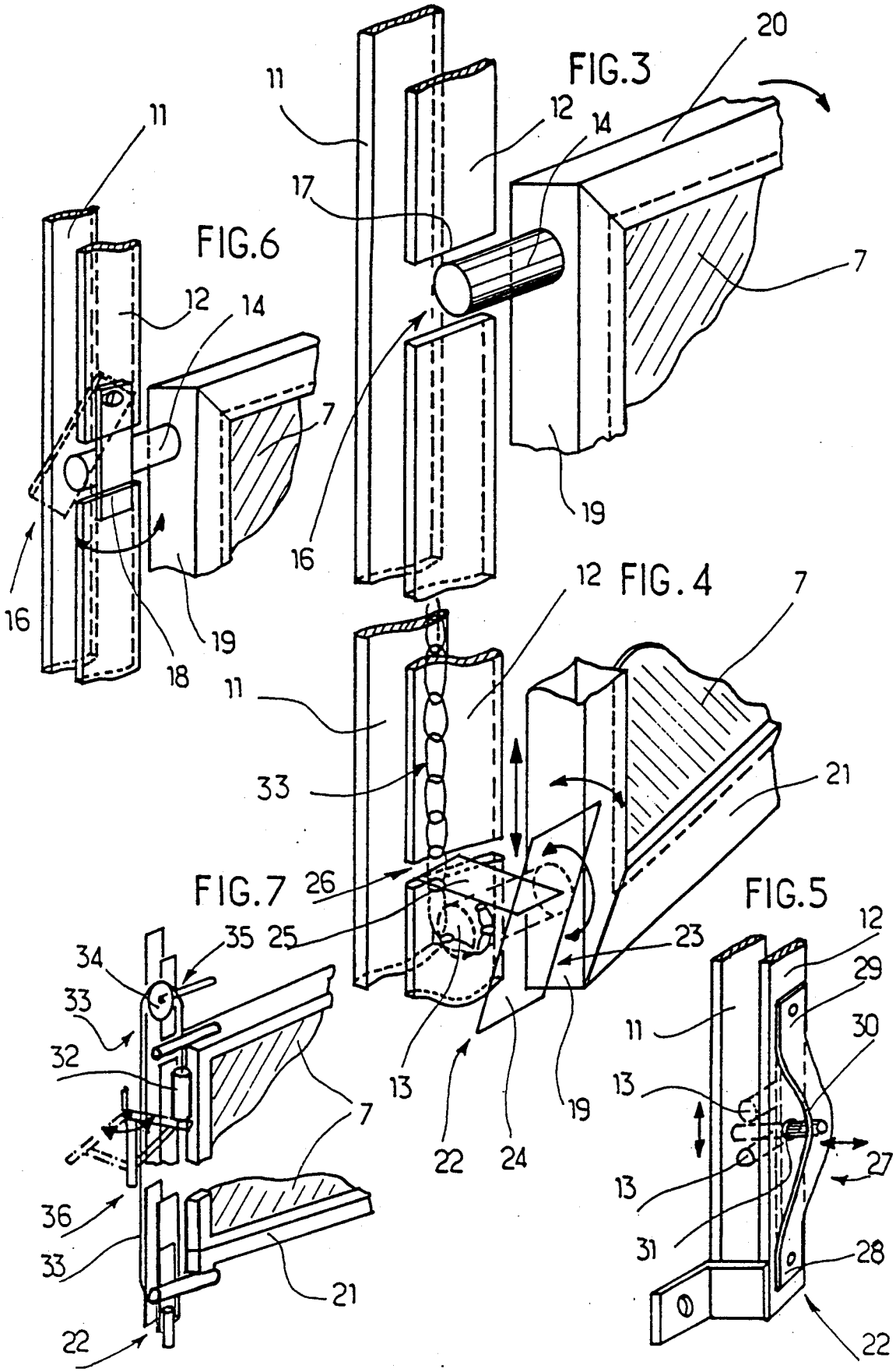
FIGS. 3 and 4 are detailed schematic views, showing in particular and respectively the upper corner, without counterweight and return, and the lower corner of the door and one of the adjacent glides, comprising a holding mechanism according to a first embodiment.
FIG. 5 is a detailed perspective view of another embodiment of the holding mechanism.
FIG. 6 is a schematic view of another embodiment of the device for lateral disengagement of the upper finger.
FIG. 7 is a simplified perspective view of another mechanism for keeping the frame of the door in the lower pivoting position by action on the counterweight.

This slit can be obstructed by a pivoting tab such as 18, as shown on FIG. 6, or by any other mechanical means, bolt or other means, which makes it possible to occasionally obtain release for lateral disengagement of the corresponding upper finger.

The frame 6 is formed of uprights such as 19, as well as an upper traverse 20 and a lower traverse 21.

During pivoting into the lower, open position, the door has a tendency to raise itself under the effect of the counterweight of the auxiliary mechanism. To prevent it from rising up, it has proven to be indispensable to provide an appropriate holding mechanism 22 at the lower part, which allows locking of the pivoting axis 15 in the lower position.

In the following, three embodiments of the holding device will be described as examples. There are certainly others, equivalent or derived, which fall within the scope of the invention.

A first possible embodiment of this device is shown in FIG. 4, at the lower part. This is a pivoting mechanism in the form of a bracket 23, arranged at right angles, which can be inclined, comprised of an inclining blade 24 and a holding plate 25 perpendicular to this blade. The holding plate 25 goes into a slit 26 which the frontal element of the glide presents to the right of this mechanism, to constitute a transverse locking or support wall for the adjacent axis or lower finger 13. It is understood that the opposite uprights is equipped with an analogous mechanism. Depending on the position of the door, the said finger is supported on the transverse plane comprised by the plate 25 when it is engaged in the glide and carries the finger 13. The blade 24 is then located against the glide and the door is in the closed position. In the configuration of pivoting to open, the said finger 13 goes below the plate 25, which keeps it locked towards the bottom, as will be seen below.

To allow operation, it is possible to provide an elastic memory for the blade 24 in the position of being held against the glide, by making it, for example, of a spring-action material (spring steel or other material), or in the form of a bracket pivoting around a lower axis, with elastic memory, for example torsion in the held-back position.

Another embodiment of the holding device 22 is shown in FIG. 5. According to this embodiment, the pivoting bracket is replaced by a convex, elastic metal blade 27 arranged longitudinally relative to the frontal flat iron 12 of the glide, attached to it at each of its ends 28 and 29, for example by riveting.

The blade 27 presents a transverse element in its middle part, in the form of a locking finger 30 which passes through the adjacent flat iron 12 by way of a passage. The locking finger 30 constitutes a support for the finger 13 in the closed position and a retainer for this finger in the lower position during pivoting. The general operation remains identical, as will be seen below.

Before examining an additional variation, we will describe below the auxiliary device for movement of the door.

Classically and with reference to FIGS. 1, 2, 8 and 9, the guillotine-type door according to the invention comprises an auxiliary mechanism 31 for movement, in the form of a counterweight 32 connected with the door by two flexible connections such as 33, by the intermediary of a movable return at an angle, in the form of pulleys or gearwheels 34.

This device is double, connected by an axis 35 common to the two pulleys or gearwheels 34.

According to the invention, this device is connected by flexible connections 33 at the ends of the lower fingers 13, which makes it possible to displace the movement return in its lowest position, that is, slightly above the upper limit of the opening of the fireplace, and to release the upper fingers 14 which can thus occasionally leave the glides laterally.

Another device or mechanism 36 provided for the same effects of locking the lower fingers 13 is shown in FIG. 7. It functions by action on the counterweight 32. This device 36 is preferably to be used in conjunction with the devices for mechanical locking intended to close off the slits 17 for the upper fingers as indicated above.

Any additional vertical displacement downwards is carried out under the effect of the weight of the door itself, since the mechanical compensation is then neutralized by stopping the descent of the counterweight of the door. The vertical force due to the weight proves to be sufficient to keep the door in the extreme lower position during the entire pivoting movement, up to complete opening in the flat, pivoted position.

Any stoppage device or other neutralizer for the action of the counterweight is suitable. It is sufficient that neutralization is in effect starting from the level of utilization produced by the position which the door occupies when the fireplace is closed.

It is understood that various other equivalent mechanisms can be imagined to retain the ends of the pivoting axis in the lower position.

One of the additional advantages of the invention resides in the fact that it becomes possible to hide the glides and the auxiliary mechanism for movement by rectilinear, esthetically pleasing, removable, retractable or fixed, vertical covers, such as 37, and an upper horizontal cover such as 38.

The vertical covers must allow disengagement of the upper fingers 14. To this, they are made to be retractable, for example by pivoting around hinges.

In the case of fixed covers, it proves to be necessary to provide disengagement openings for the upper fingers, for example notches 39.

Now we will examine the operation of the improved guillotine-type door with dual opening according to the invention.

Opening by vertical displacement of the door does not significantly differ from a conventional guillotine-type door. It is sufficient to release the locking or holding devices for the lower fingers 13.

In order to implement pivoting to a flat position, it is sufficient, if necessary, to release the slits 17 if they are blocked, and to lock the lower fingers in the lower position. The door inclines towards the outside under the effect of its own weight.

Figure 8:
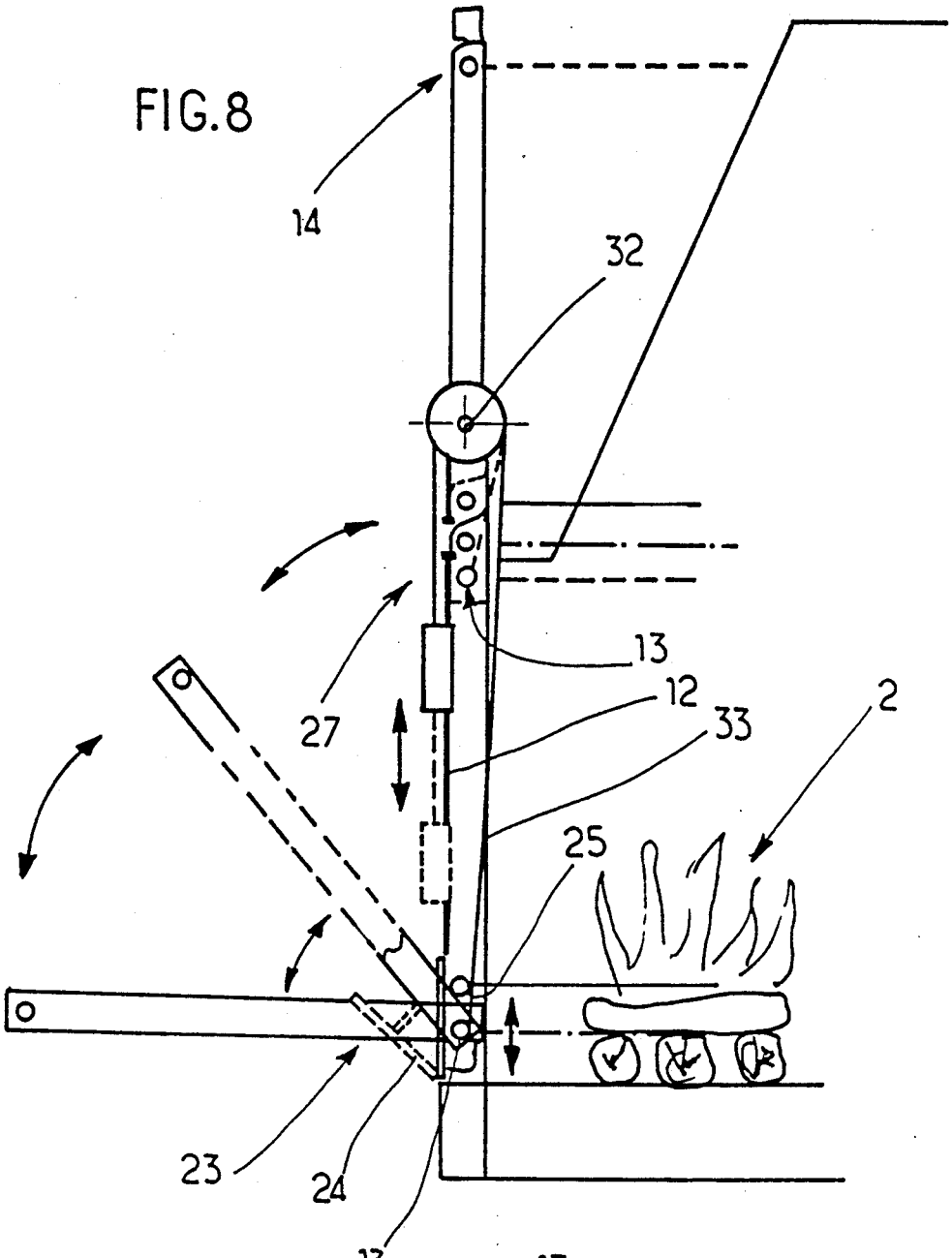
FIG. 8 is a transverse cross-section of an upright, showing the different positions of the door between a fully up and open position and a fully open, pivoted flat position.
Figure 9:
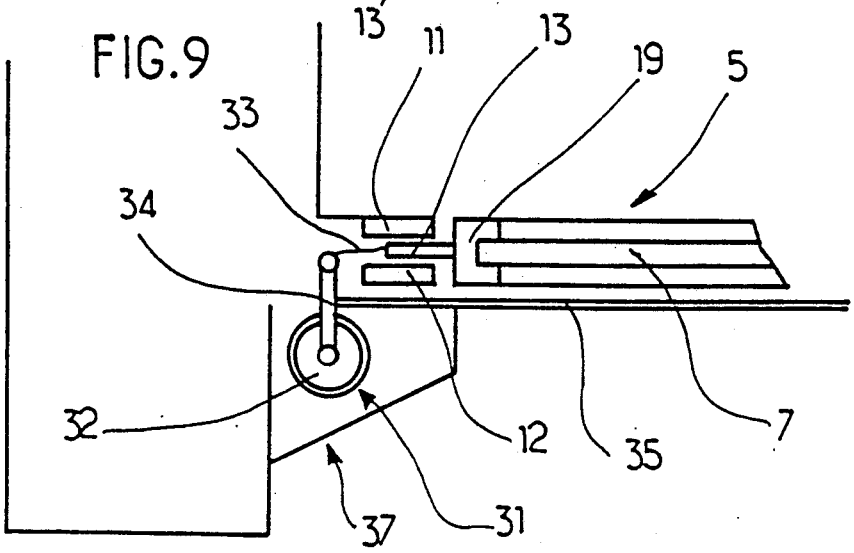
FIG. 9 is a longitudinal cross-section of one of the glides along an upright, showing the characteristic positions of the door.
Figure 10:
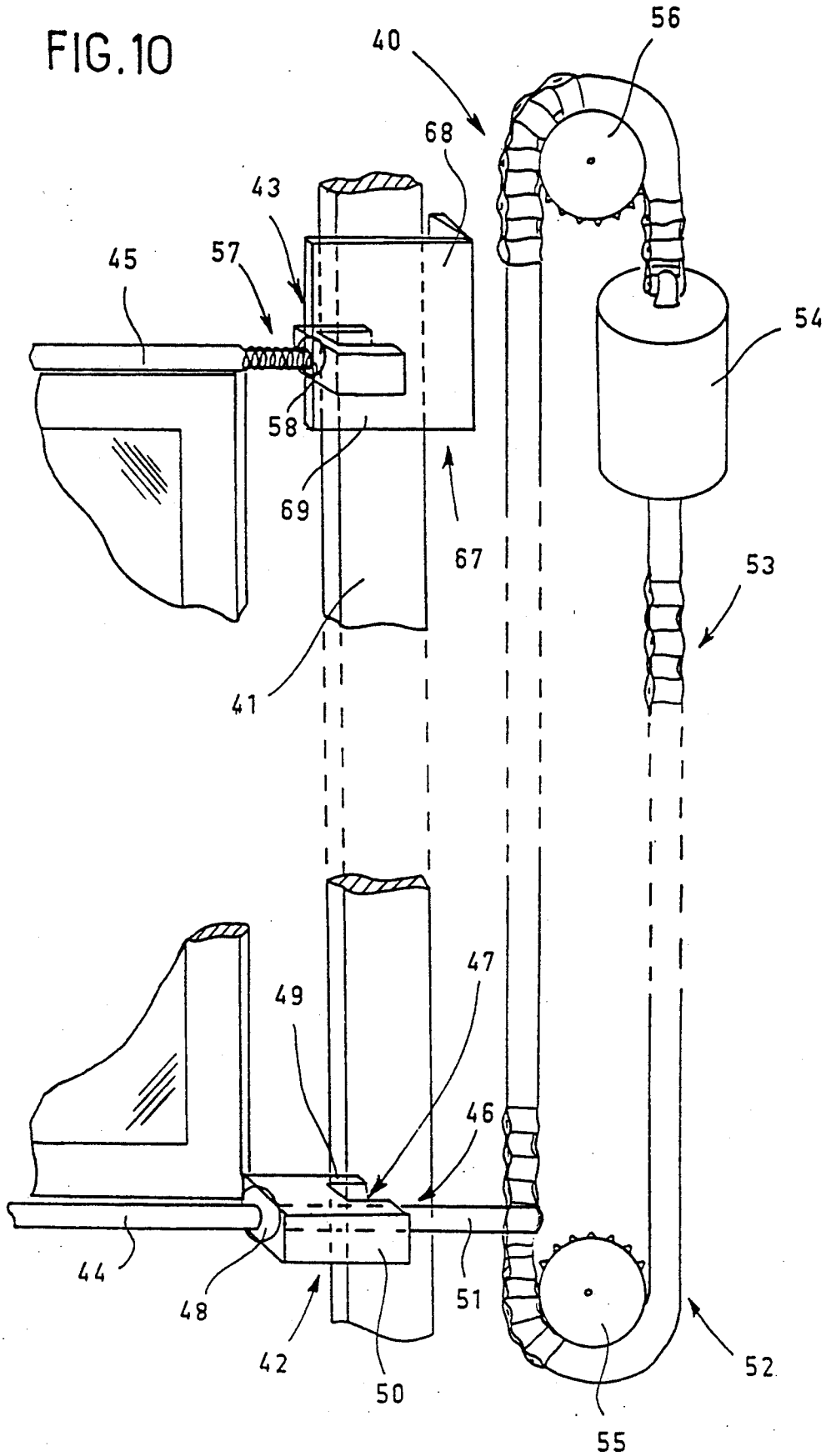
FIG. 10 is a simplified perspective view of the guidance assembly according to an improved embodiment.
Figure 11:
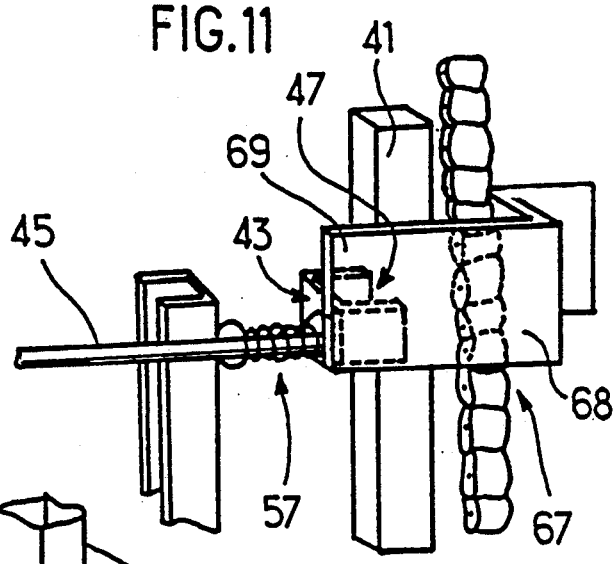
FIG. 11 is a schematic view in perspective, showing particularly the locking mechanism according to the variation shown in FIG. 10.
Figure 12:
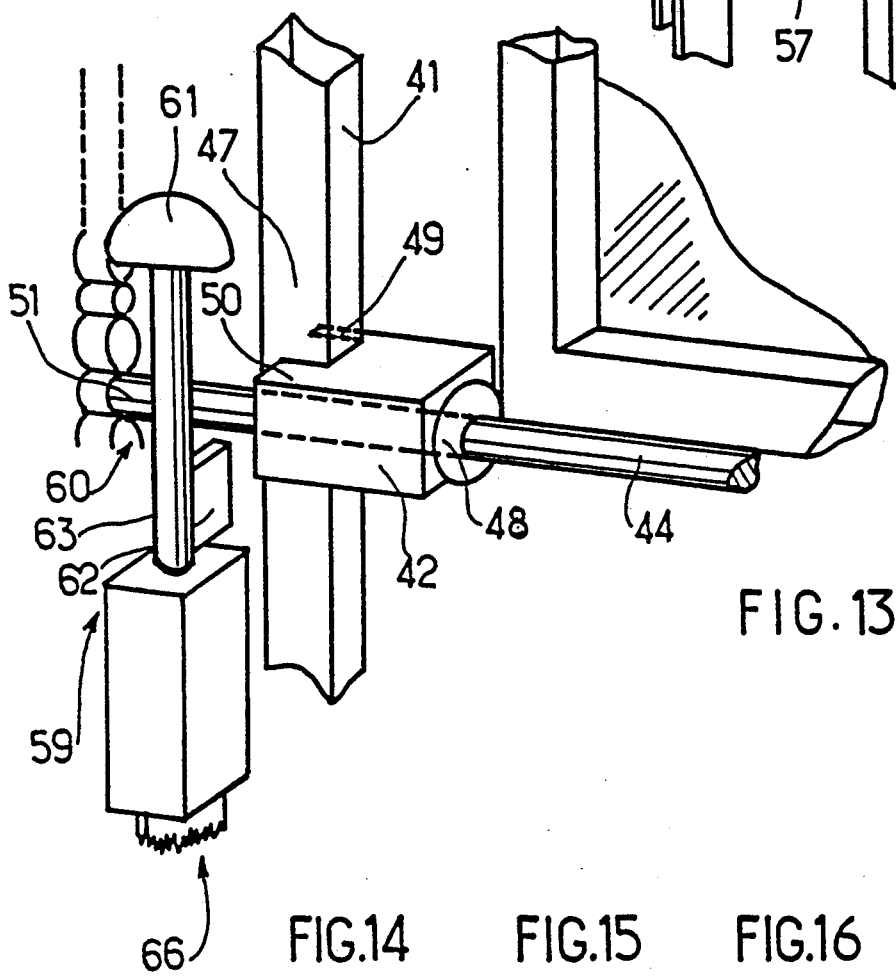
FIG. 12 is an enlargement of a perspective of an embodiment of the blocking-off mechanism of the improved variation.
Figure 13:
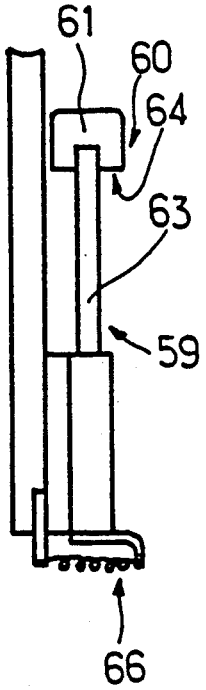
FIG. 13 is a schematic view of the profile of the support-locking mechanism.

In the following, the operation of the door with the holding device 22 by locking with a blade 24 will be described in detail, with reference to FIG. 8.

In this figure, the positions of the door have been shown by two identical lines:

upper open position with broken lines,
closed position with solid lines,
pivoting position with dot/dash lines.

For reasons of clarity, the lower fingers have been represented as black circles, and the upper fingers as white circles.

According to the embodiment, the slits 17 are simple slits and the lower axes are held by pivoting brackets.

The operation is identical with the analogous holding device 22.

In the closed position, the door rests on the holding plate 25, which forms a support, with its lower fingers 13. The position of the slits 17 on the glides is sufficiently low so that the upper fingers 14 are above the slits 17 in this position of the door. The door is therefore immobilized in a secure manner in its closed position.

To open the door in the upper position, it is sufficient to raise it until the opening is completely clear, and there is no need to retain the upper fingers in the glides.

The auxiliary device with counterweights makes the maneuver easier.

In the upper position, the placement of the slits 17 relative to the upper stop allows the lower fingers 13 to be located just below the level of the slits 17 when the door is completely raised.

Opening by pivoting is carried out in the following manner.

A suitable action on the holding devices 22 makes it possible for the lower fingers to drop into the lower position to implement pivoting. During the course of this maneuver, the plate 25 gives way by moving out of the slide, to release the path along the slide in a downward direction.

The door therefore drops slightly to a bottom point in which the lower fingers 13 are at a bottom stop at the lower end of the slides. This position corresponds exactly with the presentation of the upper fingers 14 behind the slits 17.

Upon release of the control of the holding mechanism 22, the pivoting brackets return to the held-back position, due to their elastic memory. The plate 25 returns to occupy its position of the transverse wall of the glide, which locks the lower fingers in the lower position.

The door cannot rise again under the effect of the counterweight, and pivoting takes place without hindrance, until the flat, completely lowered position has been reached.

The same is true for replacement and return to the closed position after release of the holding device.

According to a variation of the present invention, it has been provided, in order to improve the gliding movement along the glides, and in order to simplify production and use of the guillotine-type door, to replace the guide assembly formed of two parallel flat irons, between and the length of which one or the other lower finger runs.

In conformity with this variation, this replacement is carried out in favor of two assemblies arranged on one side and the other of the frame of the door, each formed of a rail, along the length of which a lower shoe and an upper shoe move, each mounted at an end of the frame, each lower show carrying one of the ends of the lower pivoting axis which traverses it, with the assembly being completed by a lower support-locking mechanism of at least one of the ends of the pivoting axis in its lower position.

More precisely, this variation proves to be remarkable in that the frame is mounted so that it pivots at the level of its lower pivoting axis and of an upper carrying axis, by means of lower and upper shoes, respectively, which run two by two, each on running rails which are present on one side and the other of the frame, each lower or upper shoe carrying one of the ends of the lower or upper axis, the said ends of the lower axis acting together with a support-locking mechanism and being connected with an auxiliary device for movement of the door.

In the following, an embodiment of this variation will be described with reference to FIGS. 10 to 14, without any intent of being limited to these particular means.

According to this variation, the mechanism for guidance and locking is composed of two similar guidance assemblies such as 40, arranged laterally on one side and the other of the frame of the door, along which it is moved vertically.

These guidance assemblies 40 essentially comprise a running rail 41, for example with a rectangular cross-section. Two shoes run on this rail, a lower shoe 42 and an upper shoe 43, mounted at the ends of the lower axis 44 and the upper axis 45, which axes are each of a piece with the corresponding horizontal edge, the lower edge and the upper edge, of the frame.

Each shoe has a frontal edge 46 with a notch such as 47, which is suitable for completely engaging with the rail, to run on it with good stability.

The lower shoes 42 each carry one of the ends of the lower pivoting axis 44, for example by fitting into the body of the shoe up to a stop-washer 48 which each end of the lower pivoting axis 44 possesses to the right of the lower corner of the face, against the side opposite that of the notch 47.

The notch 47 defined by two wings 49 and 50 is offset relative to a median plane, in such a way as to make one wing larger, for example 50. The body of each shoe is traversed by one of the ends of the adjacent axis which emerges from the wing 50 in order to act as a connecting finger 51 for the lower axis, the end of which is made into one piece with the movable connection of the auxiliary mechanical device for maneuvering the door. This device is constituted, for example, by a circuit 52 of a chain 53 with counterweights 54 between two pulleys with teeth, a lower pulley 55 and an upper pulley 56.

The upper shoes 43 are mounted to pivot on the upper axis 45 by the intermediary of a catch 57, for example a spring mechanism 58, which allows the notch 47 to be held on or retracted from the rail, thereby allowing the door to be held or released for pivoting.

As will be seen below, the effects of this extraction are cancelled out along a short distance on one side and the other of the closing position of the door, in order to require the user to lower the door first, before being able to incline it into an open position.

At least one of the guide assemblies 40 according to the present improved invention comprises a support-locking mechanism 59 for the connecting finger 51 at its lower part.

This locking mechanism will be advantageously realized in the form of a vertical pivoting key 60, which has a handle 61 and a plate 62 connected by a rod 63. The handle and the plate are offset at an angle of 90 degrees.

The handle 61 presents at its bottom a stop edge 64 for the connecting finger 51. In the same way, the plate 62 presents an upper stop edge 65, against which the connecting finger 51 is supported.

Figure 14:
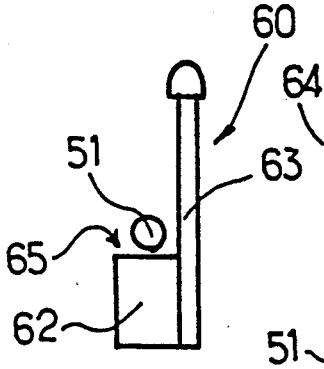
FIGS. 14, 15, and 16 show the successive positions of the support-locking mechanism at the end of the lower axis.
Figure 15:
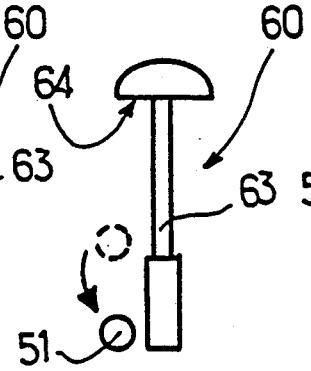
Figure 16:
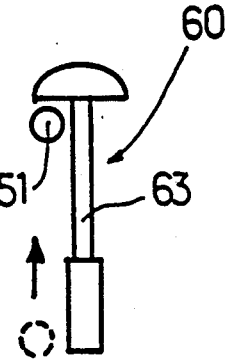

Depending on the angular position of the handle, relative to that of the connecting finger, the latter will rest on the upper edge of the plate and will be, depending on the configuration, in the lower or upper position, blocked towards the top by the handle, as illustrated in the diagrams of FIG. 14.

Advantageously, pivoting of the key will be facilitated by an auxiliary spring 66, which has the sole purpose of forcing the key 60 into one or the other of its stable operating positions.

For reasons of safety, the rail 41 has, at the upper part, on one side and the other of the position of the upper shoe, a locking device 67, for example in the form of a locking bracket 68, with a frontal wing 69 forming a transverse stop for the adjacent upper shoe.

This locking device requires the user to lower the door after activating the key 60, as will be explained below.

Operation proves to be simple. It will be explained using the diagrams of FIG. 14.

The operating position of the door in its closed position corresponds to position A of the key, in which the end 51 of the lower axis 44 rests on the upper edge of the plate 62. In this position, the pivoting movement of the door towards the front is prevented by the frontal wing of the bracket 68. Opening of the door is accomplished by successive passage through the positions B and C.

The first movement consists of turning the key in such a way as to make descent of the door to the lowest vertical position possible (position B). In this position, the upper shoes are completely released, which allows inclination-pivoting of the door towards the front.

During the course of this pivoting movement, the displacement of the center of gravity of the door cause the lower axis 45 to rise again, until it is supported/-locked against the underside of the handle 62, thus preventing it from rising any more, intentionally or unintentionally, once the door has been pivoted towards the front.

The frontal wing 69 of this bracket is sufficiently wide to prevent movement of the shoe and the door towards the front even after extraction of the upper shoe from the adjacent rail.

The general means as well as several illustrative examples of embodiments of the invention have been described above. It is understood that they do not represent any limiting character whatsoever, but that on the contrary, only evident modification, or modification accessible to a person skilled in the art, lies within the scope of protection connected with this invention.

What is claimed:

1. An improved guillotine-type door for enclosures, comprising:

a substantially planar door member;

at least one element projecting laterally outwardly from an upper peripheral portion of said door member;

at least one element projecting laterally outwardly from a lower peripheral portion of said door member;

vertically disposed guide means fixedly provided upon said enclosure for slidably guiding said at least one upper element of said door member and said at least one lower element of said door member as said door member is moved vertically between a first upper position at which said door member uncovers said enclosure so as to render said enclosure open, and a second lower position at which said door member covers said enclosure so as to render said enclosure closed; and means defined within said vertically disposed guide means for releasably engaging said at least one upper transverse element of said door member when said door member is disposed at said second lower position so as to permit said door member to pivot about a horizontal axis defined by means of said at least one lower transverse element of said door member, whereby a door member operational in two different vertically reciprocable and horizontally pivotable modes is provided for said enclosure.

2. A door according to claim 1, characterized by the fact that the laterally outwardly projecting elements are lower fingers (13) and upper fingers (14) which are integral with a frame portion of the door.

3. A door according to claim 2, characterized by the fact that the ends of the lower pivoting axis (15) are the lower fingers (13).

4. A door according to claim 3, characterized by the fact that there is further provided a device (22) for holding the door in the lower vertical position along the axis (15) which is a movable inclined bracket composed of an inclining blade (23) with elastic memory towards the guide means, carrying a holding plate (25) perpendicular to this blade, the plate passing through the guide means by a slit (26) for the purpose of constituting a transverse stop wall or support wall for the corresponding lower finger (13).

5. A door according to claim 4, characterized by the fact that the holding device (22) at the lower vertical position of the axis (15) is a transverse rod or peg on said guide means.

6. A door according to claim 2, characterized by the fact that an auxiliary mechanical device for movement of said door member is attached to each lower finger (13).

7. A door according to claim 1, characterized by the fact that the means for releasably engaging said at least one upper transverse element of said door member are slits (17) defined within said guide means of said enclosure through which said at least one upper transverse element of said door member can pass.

8. A door according to claim 2, characterized by the fact that upright portions (19) of the frame portion (6) and the upper traverse (20) are protected and hidden by vertical rectilinear covers (37) and rectilinear horizontal covers (38), fixed or removable.

9. A door according to claim 4, characterized by the fact that the auxiliary device for vertical movement of the door comprises a chain and a gearwheel on each side, the end of each chain being fixed on the corresponding lower finger (13).

10. A door according to claim 6, characterized by the fact that the guide means which allow displacement of the door member are rails forming glides, on which a lower pivoting axis (44) and an upper carrying axis (45) run by the intermediary of lower shoes (42) and upper shoes (43), the ends of which shoes are structured to engage to run on the rails forming the glides, each shoe carrying one of the ends of the lower and upper axes, respectively, and by the fact that from each lower shoe, an end of the axis emerges in the form of a connecting finger (51) connected to the auxiliary device for movement of the frame portion.

11. A door according to claim 10, characterized by the fact that the lower shoes carrying the ends of the lower axis by fitting them within their bodies and therefore serving as pillow-blocks, said axes having a stop-washer (48) disposed within the vicinity of the entrance to each shoe.

12. A door according to claim 10, characterized by the fact that the upper shoes can be retracted.

13. A door according to claim 12, characterized by the fact that the upper shoes are retractable along the length of the ends of the upper axis (45).

14. A door according to claim 10, characterized by the fact that the end of lower shoe is shaped as a notch (47) with asymmetrical wings, one smaller (49) and one larger (50), in alignment with the entry from which the end of the lower axis emerges.

15. A door according to claim 10, characterized by the fact that the connecting finger (51) is held in the lower position by a support/locking mechanism (59).

16. A door according to claim 15, characterized by the fact that the support/locking mechanism (59) has a pivoting key (60) with a rod (63) connecting a handle (61) and a plate (62) which are offset relative to one another by a 90 degree angle.

17. A door according to claim 16, characterized by the fact that handle (61) has an underside edge (64) which acts as a stop for the connecting finger (51) and by the fact that the plate has an upper stop edge (65) for the same connecting finger (51).

18. A door according to claim 16, characterized by the fact that the key is held in an operating position by an auxiliary spring (66).

19. A door according to claim 10, characterized by the fact that the rail has, at the upper part at the level of the position of the upper shoe when the door is closed, a locking device (67) composed of a stop for the movement of the door toward the front if it has not been sufficiently lowered.

20. A door according to claim 1 characterized by the fact that the means for releasably engaging said at least one upper transverse element of said door member are slits (17) defined within said guide means of said enclosure through which said at least one upper transverse element of said door member can pass and which is equipped with a mechanical lock.

* * * * *